US010090121B2

(12) United States Patent
Winter

(10) Patent No.: US 10,090,121 B2
(45) Date of Patent: Oct. 2, 2018

(54) THIN KEYBOARD DEVICE

(71) Applicant: Microsoft Technology Licensing, LLC, Redmond, WA (US)

(72) Inventor: Andrew E. Winter, Seattle, WA (US)

(73) Assignee: MICROSOFT TECHNOLOGY LICENSING, LLC, Redmond, WA (US)

( * ) Notice: Subject to any disclaimer, the term of this patent is extended or adjusted under 35 U.S.C. 154(b) by 0 days.

(21) Appl. No.: 15/270,245

(22) Filed: Sep. 20, 2016

(65) Prior Publication Data

US 2018/0082803 A1 Mar. 22, 2018

(51) Int. Cl.

| | |
|---|---|
| ***H01H 9/26*** | (2006.01) |
| ***H01H 13/72*** | (2006.01) |
| ***H01H 13/76*** | (2006.01) |
| ***H01H 13/705*** | (2006.01) |
| ***H01H 13/70*** | (2006.01) |

(Continued)

(52) U.S. Cl.

CPC ..... *H01H 13/705* (2013.01); *H01H 13/7013* (2013.01); *H01H 13/83* (2013.01); *H01R 12/78* (2013.01); *H01H 2203/028* (2013.01); *H01H 2203/058* (2013.01); *H01H 2205/032* (2013.01); *H01H 2219/028* (2013.01); *H01H 2219/036* (2013.01); *H01H 2231/002* (2013.01); *H01H 2239/056* (2013.01)

(58) Field of Classification Search

CPC ..... H01H 2203/028; H01H 2203/058; H01H 2205/032; H01H 2219/028; H01H 2219/036; H01H 2231/002; H01H 2239/056; H01H 3/00; H01H 3/12; H01H 13/00; H01H 13/20; H01H 13/50; H01H 13/70; H01H 13/7006; H01H 13/705; H01H 13/7013; H01H 13/83; H01H 2003/00; H01H 13/02; H01H 13/12; H01R 12/78

USPC ..... 200/314, 5 R, 5 A, 46, 510–514, 520, 200/521, 308, 310, 311, 312, 313, 318.1, 200/337, 341, 343, 344, 345, 329

See application file for complete search history.

(56) References Cited

U.S. PATENT DOCUMENTS 3,916,135 A * 10/1975 Holden ..... H01H 13/7013 200/275
4,527,030 A * 7/1985 Oelsch ..... H01H 1/403 200/5 A (Continued)

OTHER PUBLICATIONS

"Code Mechanical Keyboard", Available at: https://codekeyboards.com/, Aug. 28, 2013, 6 pages.

(Continued)

*Primary Examiner* — Anthony R. Jimenez

(57) ABSTRACT

A thin keyboard device is described herein. In one or more implementations, a keyboard device includes a plurality of keys, and a housing that includes a structural printed circuit board (PCB). The structural PCB includes, for each of the plurality of keys, a first conductive trace and a second conductive trace. The keyboard device further includes a key-switch mechanism for each of the plurality of keys. The key-switch mechanism includes a conductive material oriented towards the first conductive trace and the second conductive trace, and is configured to cause the conductive material to move downwards, when the key is depressed, to electrically connect the first conductive trace and the second conductive trace of the depressed key.

19 Claims, 10 Drawing Sheets

(51) Int. Cl.
*H01H 13/83* (2006.01)
*H01R 12/78* (2011.01)

(56) References Cited

U.S. PATENT DOCUMENTS

| | | | | |
|---|---|---|---|---|
| 4,677,268 | A | 6/1987 | Nemeth et al. | |
| 5,833,050 | A * | 11/1998 | Takagi | H01H 3/125 200/341 |
| 6,743,993 | B1 * | 6/2004 | Clark | H01H 13/702 200/314 |
| 6,781,077 | B2 | 8/2004 | Olodort et al. | |
| 6,894,626 | B2 | 5/2005 | Olodort et al. | |
| 7,557,312 | B2 * | 7/2009 | Clark | G06F 3/0202 200/5 A |
| 7,782,230 | B2 | 8/2010 | Olodort et al. | |
| 8,403,576 | B2 * | 3/2013 | Merz | G06F 1/1624 200/310 |
| 9,368,300 | B2 | 6/2016 | Casparian et al. | |
| 2011/0073454 | A1 * | 3/2011 | Chen | H01H 13/704 200/5 A |
| 2013/0228437 | A1 * | 9/2013 | Lee | H01H 13/85 200/5 A |
| 2015/0114813 | A1 | 4/2015 | Chen et al. | |

OTHER PUBLICATIONS

"Comparing Mechanical, Membrane and Scissor-Switch Membrane Keyboards—Ergonomic Considerations of Keyswitch Type", Available at: http://www.ergopedia.ca/ergonomic_concepts/Mechanical_Keyswitches_Membrane_Keyswitches_and_Scissor_Switch_Membrane_Keyswitches_Ergonomic_Considerations.html, Jan. 19, 2014, 8 pages.

"DeCK 82 Key Backlit Keyboard—Ice (Blue) by Deck", Retrieved on: Jun. 23, 2016,—Available at: http://test.performance-pcs.com/d-ck-82-key-backlit-keyboard-ice-blue.html, 2 pages.

"Keyboard Technology", Available at: http://flylib.com/books/en/4.57.1.160/1/, May 18, 2013, 14 pages.

"Membrane Keyboard Switches", Available at: https://forum.lowyat.net/topic/2818369/all, May 20, 2013, 9 pages.

"Our Products—Domes", Available at: http://www.polytech.com.sg/Domes.html, Jun. 18, 2013, 3 pages.

"Paper Membrane Switches for Fully Featured Computer Keyboards", Retrieved on: Jun. 23, 2016,—Available at: http://dea.brunel.ac.uk/cleaned/electronics_projects/Handbook_3.htm, 7 pages.

Stazzone,"Carbon Tactile Keys: What are They, What do They do?", Available at: http://www.pannam.com/blog/carbon-tactile-key/, Aug. 9, 2015, 5 pages.

* cited by examiner

THIN KEYBOARD DEVICE

BACKGROUND

Keyboards are an important and popular input mechanism for providing input to a variety of computing devices. In order to keep up with consumer demand for smaller, more portable computing devices, keyboard designs have moved toward correspondingly thinner and smaller designs. Making the keyboard smaller with respect to the total area of the keyboard works in tension with the need for keyboards to remain usable given the size constraints of the human finger that is used for actuating the keyboard elements, or keys. The thickness of the keyboard, however, can still be improved to provide a thinner, sleeker design for either the computing device in which it is embedded, or the keyboard peripheral device itself, making for improved portability of the keyboard device.

SUMMARY

A thin keyboard device is described herein. In one or more implementations, a keyboard device includes a plurality of keys, and a housing that includes a structural printed circuit board (PCB). The structural PCB includes, for each of the plurality of keys, a first conductive trace and a second conductive trace. The keyboard device further includes a key-switch mechanism for each of the plurality of keys. The key-switch mechanism includes a conductive material oriented towards the first conductive trace and the second conductive trace, and is configured to cause the conductive material to move downwards, when the key is depressed, to electrically connect the first conductive trace and the second conductive trace of the depressed key.

In one or more implementations, a keyboard device includes a plurality of keys, and a housing that includes a three-layer membrane. The three-layer membrane includes, for each of the plurality of keys, a first conductive trace and a second conductive trace which are positioned on a bottom layer of the three-layer membrane, a conductive material that is positioned on a top layer of the three-layer membrane, and a spacer layer positioned between the top layer and the bottom layer. The keyboard device further includes a key-switch mechanism that is configured to collapse the three-layer membrane, when the key is depressed, such that the conductive material on the top layer of the three-layer membrane moves downwards through the spacer layer to electrically connect the first conductive trace and the second conductive trace of the depressed key.

In one or more implementations, a keyboard device includes a plurality of keys, and a housing that includes a single-layer membrane. The single-layer membrane includes, for each of the plurality of keys, a first conductive trace and a second conductive trace. The keyboard device further includes a key-switch mechanism, for each of the plurality of keys, which includes a conductive material that is oriented towards the first conductive trace and the second conductive trace. The key-switch mechanism is configured to cause the conductive material to move downwards, when the key is depressed, to electrically connect the first conductive trace and the second conductive trace.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

BRIEF DESCRIPTION OF THE DRAWINGS

The detailed description is described with reference to the accompanying figures. In the figures, the left-most digit(s) of a reference number identifies the figure in which the reference number first appears. The use of the same reference numbers in different instances in the description and the figures may indicate similar or identical items. Entities represented in the figures may be indicative of one or more entities and thus reference may be made interchangeably to single or plural forms of the entities in the discussion.

DETAILED DESCRIPTION

Figure 1:
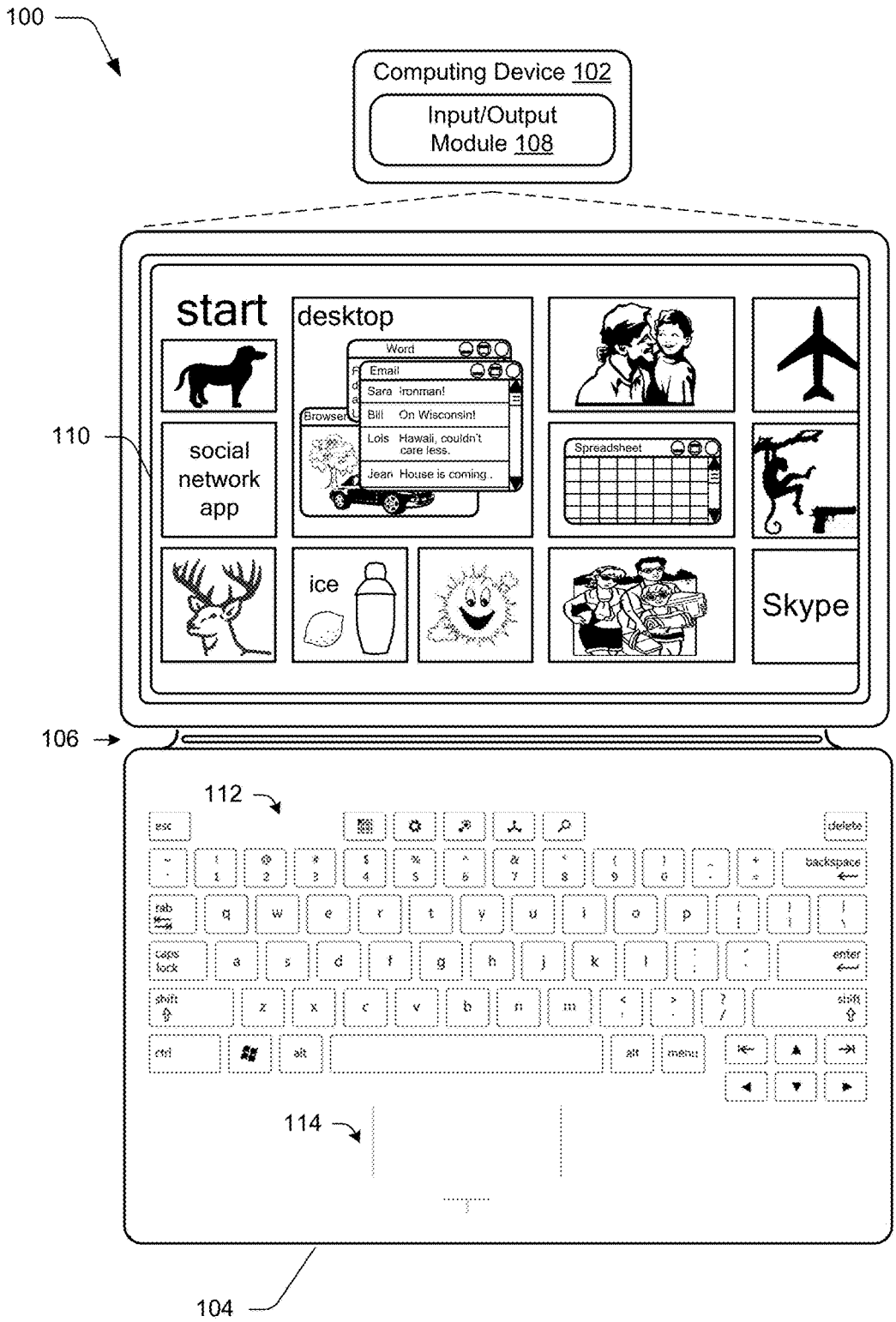
FIG. 1 is an illustration of an environment in an example implementation that is operable that is operable to employ the thin keyboard device described herein.

Compared to conventional keyboards on the market today, the thin keyboard devices described herein are thinner, stiffer, lighter, draw less power, simplify the supply chain, remove a number of steps from the main assembly line, and may be less expensive. Furthermore, the thin keyboard devices described herein do not sacrifice performance to achieve any of these benefits.

In one or more implementations, a keyboard device includes a plurality of keys, and a housing that includes a three-layer membrane. The three-layer membrane includes a top layer, a bottom layer, and a spacer layer that is positioned between the top and bottom layer. Unlike existing three-layer membranes in which first and second conductive traces are placed on different levels of the three-level membrane, the three-level membrane described herein positions both the first and second conductive traces on the bottom layer of the three-layer membrane. A conductive material is positioned on a top layer of the three-layer membrane and oriented towards the first conductive trace and the second conductive trace. The keyboard device further includes a key-switch mechanism (e.g., a scissor mechanism and/or a dome switch) for each of the plurality of keys that is configured to collapse the three-layer membrane, when the key is depressed, such that the conductive material on the top layer of the three-layer membrane moves downwards through the spacer layer to electrically connect the first conductive trace and the second conductive trace of the depressed key.

In one or more implementations, the three-layer membrane of the keyboard device is redesigned as a single-layer membrane that includes the first conductive trace and the second conductive trace. In this case, instead of being positioned in the three-layer membrane, the conductive material is positioned on the key-switch mechanism (e.g., on a plunger of a dome switch) and oriented towards the first and second conductive traces. When a key of the keyboard device is depressed, the conductive material of the key-switch mechanism moves downwards to electrically connect the first conductive trace and the second conductive trace of the depressed key. Notably, the single-layer membrane is much thinner than the typical three-layer membrane. Thus, utilizing the single-layer membrane results in a reduction in the thickness of the keyboard device without sacrificing functionality or effectiveness of the keypress detection system.

In one or more implementations, in order to further decrease the thickness of the keyboard device while also improving its functionality, a housing of the keyboard device can be redesigned to include a structural printed circuit board (PCB). The structural PCB can replace a stiffener plate that is utilized by existing keyboards, while also providing increased functionality. For example, in one or more implementations, the first and second conductive traces are moved from the membrane to the structural PCB. Doing so enables the membrane to be completely eliminated form the keyboard device, which results in a substantially thinner keyboard device as compared to existing keyboards.

In one or more implementations, the thickness of the keyboard device is further reduced by mounting individual light sources (e.g., LEDs) to the structural PCB which are controllable to illuminate individual keys of the keyboard. Doing so enables the backlight module to be completely eliminated from the keyboard device, which further reduces the thickness of the keyboard.

Example Environment

FIG. 1 is an illustration of an environment 100 in an example implementation that is operable to employ the thin keyboard device described herein. The illustrated environment 100 includes an example of a computing device 102 that is physically and communicatively coupled to a thin keyboard device 104, which may also be referred to as "keyboard device 104" or "keyboard 104" herein. In this example, the computing device 102 is physically and communicatively coupled to the keyboard device 104 via a flexible hinge 106, however other connection mechanisms are also contemplated. The computing device 102 may be configured in a variety of ways. For example, the computing device 102 may be configured for mobile use, such as a mobile phone, a tablet computer as illustrated, and so on. Thus, the computing device 102 may range from full resource devices with substantial memory and processor resources to a low-resource device with limited memory and/or processing resources. The computing device 102 may also relate to software that causes the computing device 102 to perform one or more operations.

The computing device 102, for instance, is illustrated as including an input/output module 108. The input/output module 108 is representative of functionality relating to processing of inputs and rendering outputs of the computing device 102. A variety of different inputs may be processed by the input/output module 108, such as inputs relating to functions that correspond to keys of the keyboard device 104, keys of a virtual keyboard displayed by the display device 110 to identify gestures and cause operations to be performed that correspond to the gestures that may be recognized through the keyboard device 104 and/or touch-screen functionality of the display device 110, and so forth. Thus, the input/output module 108 may support a variety of different input techniques by recognizing and leveraging a division between types of inputs including keypresses, gestures, and so on.

In the illustrated example, the keyboard device 104 has an input portion that includes keys 112 and a trackpad 114. The trackpad 114 in the illustrated example is formed as a rectangle having four corners, although other shapes are also contemplated.

In this example, keyboard device 104 has a QWERTY arrangement of keys 112 although other arrangements of keys 112 are also contemplated, such AZERTY, QWERTZ, or Dvorak. Alternative examples can also comprises fewer or more keys 112 than the keyboard 104 shown in FIG. 1. For example, an alternative keyboard may include a numerical keypad on the right hand side. Furthermore, in some cases, keyboard device 104 can be implemented without a trackpad 114, such as a standard mechanical keyboard configured to be connected to a PC. Keyboard device 104 may be implemented as a variety of different keyboards, including by way of example and not limitation, existing mechanical-switch keyboards, membrane-based keyboards, dome-switch keyboards, or scissor-switch keyboards, and so forth. Further, other non-conventional configurations of a keyboard having keys are also contemplated, such as a game controller, configuration to mimic a musical instrument, and so forth. Thus, the keyboard device 104 and keys 112 incorporated by the keyboard device 104 may assume a variety of different configurations to support a variety of different functionality.

As previously described, the keyboard device 104 is physically and communicatively coupled to the computing device 102 in this example through use of a flexible hinge 106. The flexible hinge 106 is flexible in that rotational movement supported by the hinge is achieved through flexing (e.g., bending) of the material forming the hinge as opposed to mechanical rotation as supported by a pin, although that implementation is also contemplated. Further, this flexible rotation may be configured to support movement in one or more directions (e.g., vertically in the figure) yet restrict movement in other directions, such as lateral movement of the keyboard device 104 in relation to the computing device 102. This may be used to support consistent alignment of the keyboard device 104 in relation to the computing device 102, such as to align sensors used to change power states, application states, and so on.

The flexible hinge 106, for instance, may be formed using one or more layers of fabric and include conductors formed as flexible traces to communicatively couple the keyboard device 104 to the computing device 102 and vice versa. This communication, for instance, may be used to communicate a result of a keypress to the computing device 102, receive power from the computing device, perform authentication, provide supplemental power to the computing device 102, and so on. The flexible hinge 106 may be configured in a variety of ways, further discussion of which may be found in relation to FIG. 2.

Figure 2:
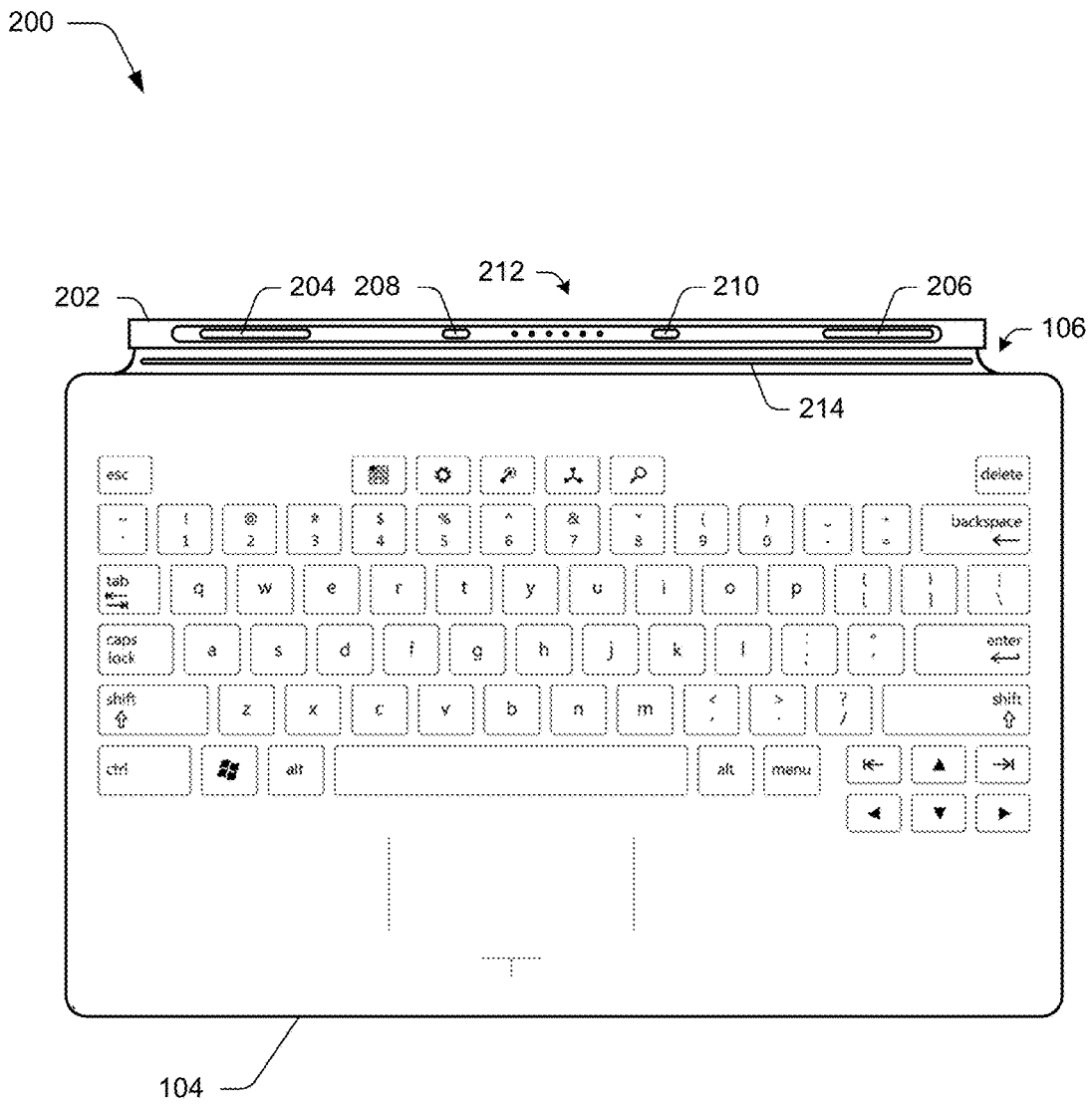
FIG. 2 depicts an example implementation of an input device of FIG. 1 as showing a flexible hinge and trackpad in greater detail.

FIG. 2 depicts an example implementation 200 of the keyboard device 104 of FIG. 1 as showing the flexible hinge 106 in greater detail. In this example, a connection portion 202 of the keyboard device is shown that is configured to provide a communicative and physical connection between the keyboard device 104 and the computing device 102. The connection portion 202 as illustrated has a height and cross section configured to be received in a channel in the housing of the computing device 102, although this arrangement may also be altered or reversed without departing from the spirit and scope thereof.

The connection portion 202 is flexibly connected to a portion of the keyboard device 104 that includes the keys 112 through use of the flexible hinge 106. Thus, when the connection portion 202 is physically connected to the computing device the combination of the connection portion 202 and the flexible hinge 106 supports movement of the keyboard device 104 in relation to the computing device 102 that is similar to a hinge of a book. Through this rotational movement, a variety of different orientations of the keyboard device 104 in relation to the computing device 102 may be supported, such as to act to cover the display device 110 of FIG. 1, be disposed behind the housing of the computing device 102, and so forth.

The connection portion 202 is illustrated in this example as including magnetic coupling devices 204, 206, mechanical coupling protrusions 208, 210, and a plurality of communication contacts 212. Although physical communication contacts 212 are shown in this example, wireless communication techniques are also contemplated, e.g., NFC, Bluetooth®, and so forth. The magnetic coupling devices 204, 206 are configured to magnetically couple to complementary magnetic coupling devices of the computing device 102 through use of one or more magnets. In this way, the keyboard device 104 may be physically secured to the computing device 102 through use of magnetic attraction.

The connection portion 202 also includes mechanical coupling protrusions 208, 210 to form a mechanical physical connection between the keyboard device 104 and the computing device 102. The mechanical coupling protrusions 208, 210 are configured to permit removal of the keyboard device 104 along a plane following a height of the protrusions and restrict removal through mechanical binding along other planes. A mid-spine 214 is also included to support mechanical stiffness and a minimum bend radius of the flexible hinge 106.

Figure 3:
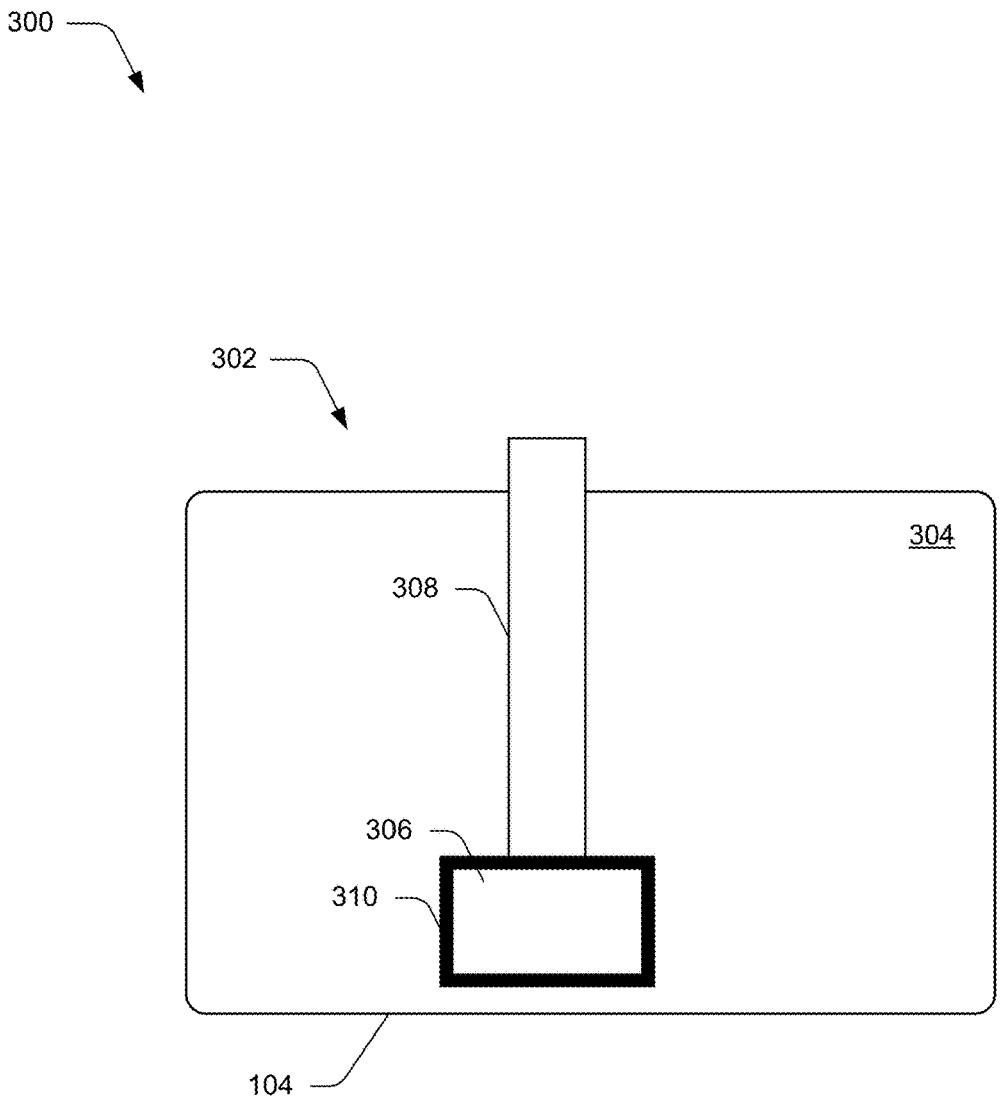
FIG. 3 depicts an example of a housing of the keyboard device of FIG. 1 in accordance with one or more implementations.

FIG. 3 depicts an example 300 of a housing of the keyboard device 104 of FIG. 1 in accordance with one or more implementations.

In this example, the keys 112 and top layer of the keyboard device 104 are removed to show a housing 302 of keyboard device 104 which includes a stiffener plate 304, a keyboard controller 306, and a long flexible printed circuit board connector (FPC) 308 that connects the keyboard controller 306 to the computing device 102 (e.g., via connection portion 202). Generally, keyboard controller 306 is configured to detect a keypress by detection of an electrical connection between conductive traces of a respective key 112, and to communicate a keypress signal to computing device 102 which identifies that the key 112 has been depressed. For example, the keypress signal can be communicated to computing device 102 via FPC 308 which interfaces with connection portion 202.

The keyboard controller 306 may be implemented in a variety of different ways. In one or more implementations, the keyboard controller 306 is implemented as a multi-layered printed circuit board (PCB), such as a 6-layer brain PCB, or as a CapSense PCB. In this example, the keyboard controller 306 is positioned underneath the trackpad 114 of keyboard device 104, but it is to be noted that the keyboard controller 306 could alternately be positioned anywhere else on the housing 302 of keyboard device 104.

A black mask 310 is formed around the keyboard controller 306 in order to hide the FR4 color of the keyboard controller 306. For example, without the black mask 310, a user of keyboard device 104 may be able to see the FR4 color along the edges of the trackpad 114.

Figure 4:
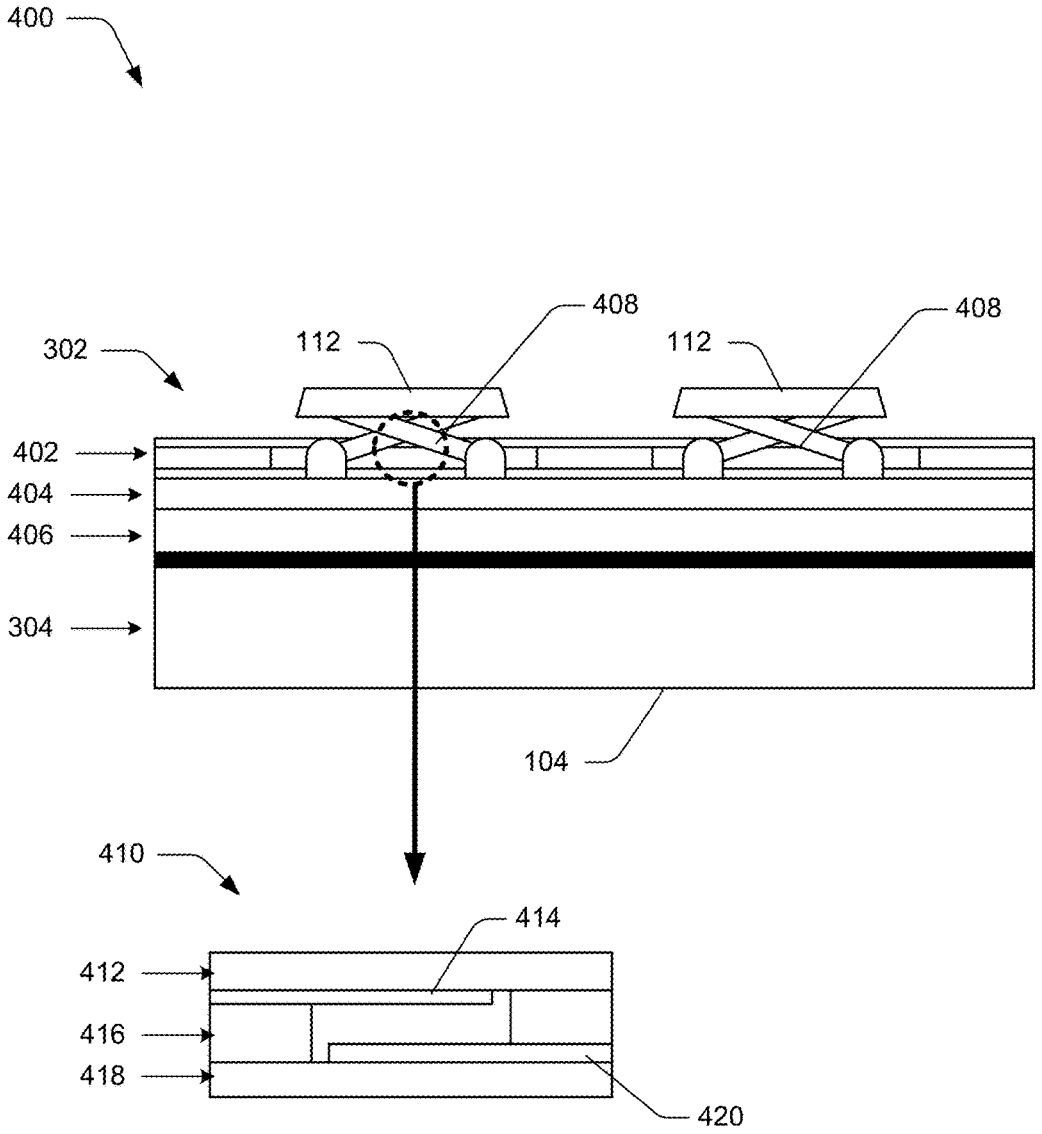
FIG. 4 depicts an example cross-section view of the keyboard device of FIG. 1 in accordance with one or more implementations.

FIG. 4 depicts an example cross-section view 400 of the keyboard device 104 of FIG. 1 in accordance with one or more implementations.

In this example, housing 302 of the keyboard device 104 includes a three-layer membrane 402, a keyboard bracket 404, a backlight 406, and stiffener plate 304. Two example keys 112 are depicted as being attached to the keyboard bracket 404 of housing 302. As described throughout, keys 112 may correspond to keys of keyboard device 104 of FIG. 1, or to any other type of keyboard. Backlight 406 is configured to output light to illuminate keys 112 such that the keys 112 can be seen by the user in low light conditions.

The individual layers of the housing 302 (e.g., the three-layer membrane 402, the keyboard bracket 404, and the backlight 406) may be adhered together using a pressure-sensitive adhesive, which is not good for holding forces in sheer, and thus makes the entire product somewhat flexible. Thus, the stiffener plate 304 is utilized to compensate for the flexibility of the other pieces in order to make the keyboard device 104 rigid.

In this example, the keys 112 are mounted to the keyboard bracket 404, via a key-switch mechanism 408. The key-switch mechanism 408 is depicted as a scissor mechanism, however, other types of switches may also be utilized, including by way of example and not limitation, a mechanical-switch or a dome-switch. In one or more implementations, and as will be described in more detail below, the key-switch mechanism 408 includes both a scissor mechanism and a dome switch.

At 410, a more detailed view of three-layer membrane 402 is shown. In this example, three-layer membrane 402 includes a top layer 412 which includes a first conductive trace 414 positioned on the bottom surface of the top layer, a spacer layer 416, and a bottom layer 418 which includes a second conductive trace 420 positioned on the top surface of the bottom layer. The spacer layer 416 includes a hole or air gap at the position of each key 112, and acts to keep the first conductive trace 414 and second conductive trace 420 apart from each other so that they do not make electrical contact until the respective key 112 is depressed.

When key 112 is depressed (e.g., from a user's finger pressing down on the key 112), the key-switch mechanism 408 collapses the three-layer membrane 402 such that the first conductive trace 414 and second conductive trace 420 are electrically connected. In other words, the key-switch mechanism 408 pushes the first conductive trace 414 down through the respective hole in the spacer layer 416 to touch the second conductive trace 420, which forms an electrical connection between the first and second conductive traces. As described throughout, keyboard controller 306 can detect this electrical connection and register it as a keypress of the respective key 112.

Notably, each of these different layers of keyboard device 104 increases the total thickness of the keyboard. For instance, the thickness of the three-layer membrane 402 may be approximately 0.20 to 0.30 millimeters, the thickness of the keyboard bracket 404 may be approximately 0.15 to 0.25 millimeters, the thickness of the backlight 406 may be approximately 0.30 to 0.40 millimeters, and the thickness of the stiffener plate 304 may be approximately 0.70 to 0.90 millimeters. This adds up to a total thickness of the housing of the keyboard device 104 being approximately 1.35 to 1.85 millimeters. As will be discussed in more detail below, a thin keyboard device 104 may be implemented by removing one or more of the three-layer membrane, the keyboard bracket, the backlight, or the stiffener plate in order to reduce the thickness of the keyboard from approximately to as low as approximately 0.70 millimeters without sacrificing keyboard functionality.

In accordance with one or more implementations, the stiffener plate 304 of keyboard device 104 can be replaced by a structural PCB. Consider, for example, FIG. 5 which depicts example implementations 500 of the keyboard device 104 of FIG. 1.

At 502, housing 302 of keyboard device 104 includes a structural PCB 504, keyboard controller 306, and shortened FPC's 506-1 and 506-2 which connect the keyboard controller 306 to the computing device 102 (e.g., via connection portion 202). The keyboard controller 306 is configured to detect user input to keyboard device 104 (e.g., keypress input to keys 112 or gesture input to trackpad 114), and communicate data indicative of the user input to computing device 102 via the FPC's 506-1 and 506-2 and connection portion 202. The structural PCB 504 may correspond to a single-layer or two-layer PCB.

Notably, the structural PCB 504 replaces the stiffener plate 304 of FIG. 3, which results in several advantages. First, by utilizing a structural PCB as the backing for keyboard device 104, circuitry on the structural PCB 504 can be utilized to connect the FPC 506-1 to the FPC 506-2. The total length of the FPC's 506-1 and 506-2 is less that the total length of the FPC 308 illustrated in FIG. 3. Thus, replacing the stiffener plate 304 with the structural PCB 504 enables the amount of FPC to be reduced, thereby reducing the total cost of manufacturing the keyboard device 104 by as much as $1.00. Additionally, in this example, the black mask 310 of the keyboard illustrated in FIG. 3 may be replaced with a black solder mask around the structural PCB 504, which results in a further cost savings of approximately $0.40 or $0.50.

In one or more implementations, individual light sources can be mounted to the structural PCB and controlled to illuminate the keys 112 of keyboard device 104. Doing so enables the backlight 406 to be eliminated from keyboard device 104. For example, at 508, the structural PCB 504 is depicted as including individual light sources 510, such as light-emitting diodes (LEDs). The light sources 510 can be controlled to illuminate the individual keys 112 of keyboard device 104. In some cases, at least one light source 510 is placed under each key 112 of the keyboard device 104, and can be controlled to illuminate the respective key. For larger keys, more than one light source 510 may be placed under the respective key. For example, two or more light sources may be placed under the backspace key of keyboard device 104.

At 512, a side-view of the keyboard device 104 implemented with structural PCB 504 and individual light sources 510 is illustrated. In this example, note that by utilizing individual light sources 510 to illuminate the keys 112, the entire backlight 406 of the keyboard device of FIGS. 3 and 4 has been removed, which reduces the thickness of the keyboard device 104 depicted in FIGS. 3 and 4 by approximately 0.35 millimeters. The thickness of the structural PCB 504 may be as low as 0.70 to 0.80 millimeters, which is similar to the thickness of a typical stiffener plate. Thus, replacing the stiffener plate with the structural PCB results in the several advantages discussed above and below, without adding any additional thickness to the keyboard device 104.

Additionally, using individual light sources 510, as opposed to the backlight 406, to illuminate the keys 112 of keyboard device 104 makes the lighting process easier to control thereby resulting in light uniformity that is as good, or even better, than the light uniformity of using a single backlight to illuminate the keyboard.

Notably, the light sources 510 can be controlled individually. Thus, in some cases, during manufacturing of the keyboard device 104, a camera can be mounted above the keyboard device 104 and configured to take a picture of the entire keyboard lit up by the individual light sources 510. Then, image processing software can be utilized to tune the light sources 510 individually to make sure that each light source is on at the right brightness. To do so, the image processing software can calculate the brightness of each key 112 on the keyboard device 104 individually, and then adjust corresponding light sources 510 individually as needed. For instance, if the "Q" key is brighter than the "R" key, then the "Q" key can be dialed down so that it matches the brightness of all of the other keys.

Figure 6:
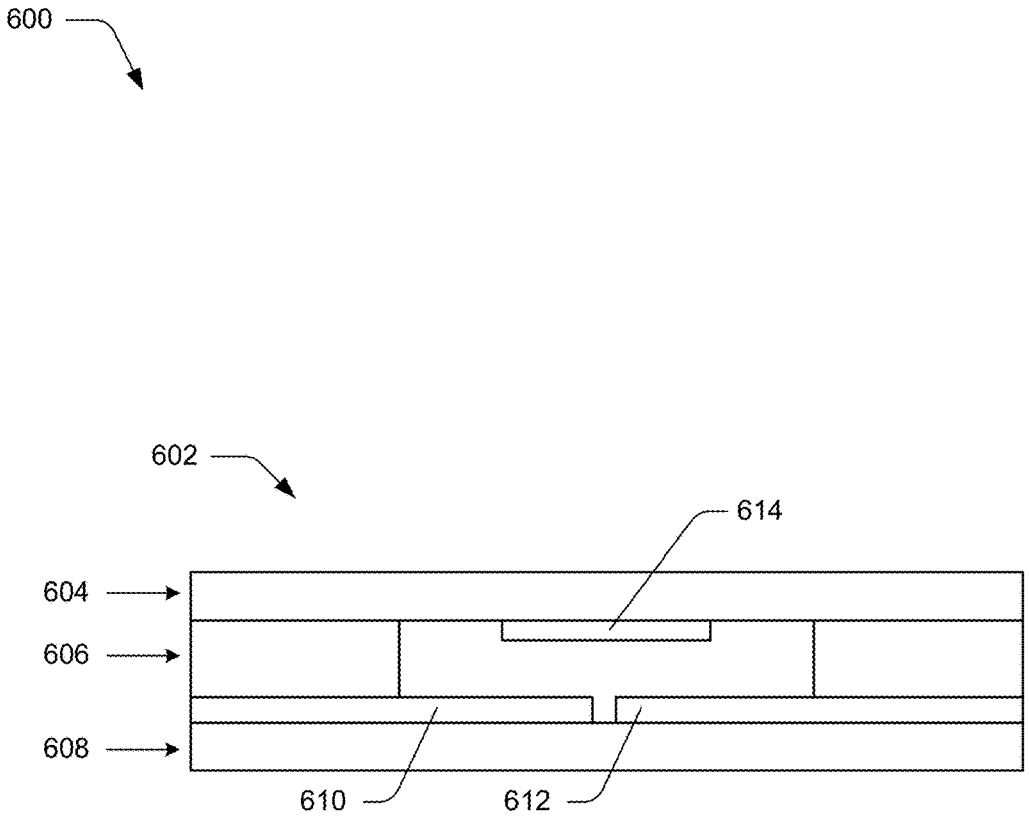
FIG. 6 depicts an example of a three-layer membrane with first and second conductive traces on a single layer of the three-layer membrane in accordance with one or more implementations.

In accordance with one or more implementations, the three-layer membrane 402 of keyboard device 104 can be redesigned by positioning the first and second conductive traces on a the bottom layer of the three-layer membrane. As an example, consider FIG. 6 which depicts an example 600 of a three-layer membrane with first and second conductive traces on a single layer of the three-layer membrane in accordance with one or more implementations.

In this example, a three-layer membrane 602 includes a top layer 604, a spacer layer 606, and a bottom layer 608, similar to that of three-layer membrane 402 of FIG. 4. Unlike three-layer membrane 402, however, the bottom layer 608 of the three-layer membrane 602 includes both a first conductive trace 610 and a second conductive trace 612. Recall, that in the three-layer membrane 402 of FIG. 4, the first conductive trace is placed on the top layer, and the second conductive trace is placed on the bottom layer.

In this case, rather than spacing the first and second conductive traces using the spacer layer, the first and second conductive traces are spaced apart from each other on the bottom layer (e.g., there is small gap between the conductive traces on the bottom layer). In order to enable this gap to be closed, the three-layer membrane 602 further includes a conductive material 614 which is placed on the top layer 604. When the respective key 112 is depressed, the keyswitch mechanism causes the conductive material 614 to move downwards through the spacer layer 606 to electrically connect the first conductive trace 610 and second conductive trace 612 for the respective key 112. As described above, the keyboard controller 306 can detect this electrical connection and register it as a keypress of the respective key.

Figure 5:
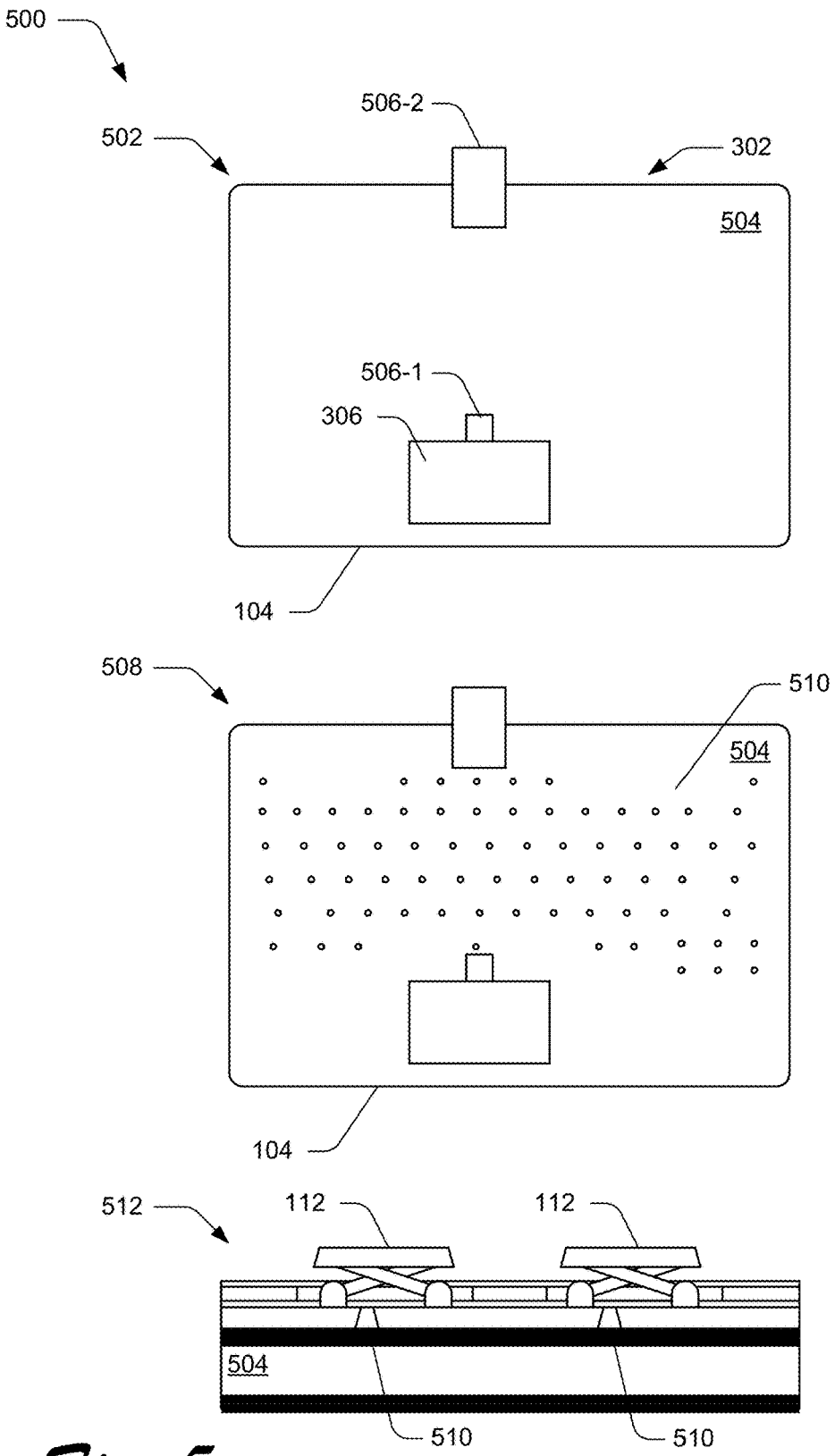
FIG. 5 depicts example implementations of the keyboard device of FIG. 1.

The redesigned three-layer membrane 602 can be implemented in any type of keyboard device 104 which utilizes a three-layer membrane to sense keypresses, such as the keyboard with stiffener plate of FIGS. 3 and 4, or the keyboard with structural PCB of FIG. 5, or any other type of existing keyboard which utilizes a three-layer membrane to sense keypresses.

In accordance with one or more implementations, the three-layer membrane 402 (FIG. 4) or three-layer membrane 602 (FIG. 6) can be redesigned by placing the first and second conductive traces on a single-layer membrane and placing the conductive material on the key-switch mechanism.

Figure 7A:
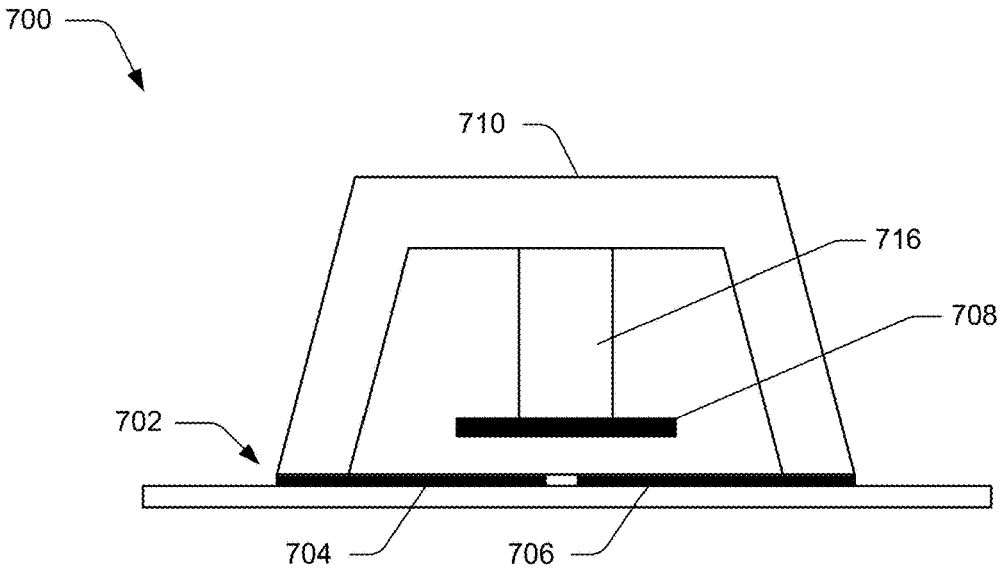
FIG. 7A depicts an example of a single-layer membrane in accordance with one or more implementations.

As an example, consider FIG. 7A which depicts an example 700 of a single-layer membrane in accordance with one or more implementations.

In this example, a single-layer membrane 702 includes just a single layer (e.g., the top and spacer layers of the three-layer membrane are removed). A first conductive trace 704 and a second conductive trace 706 are each positioned on the single-layer membrane 702. In this case, rather than placing the conductive material on the top layer as described with regards to FIG. 6, a conductive material 708 is placed on the key-switch mechanism and oriented towards the first and second conductive traces 704 and 706, respectively. When the key 112 is depressed, the key-switch mechanism causes the conducive material 708 to move downwards and electrically connect the first conductive trace 704 and second conductive trace 706 for the respective key 112. As described throughout, the keyboard controller 306 can detect this electrical connection and register it as a keypress of the respective key 112.

Figure 7B:
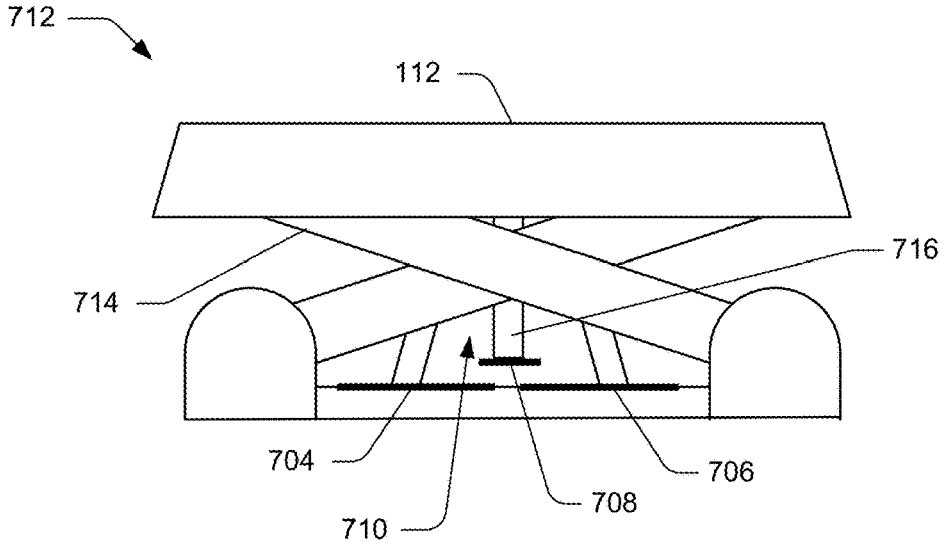
FIG. 7B illustrates an example in which a dome switch is implemented with a scissor mechanism.

In this example, the key-switch mechanism includes a dome switch 710. In one or more implementations, the dome switch 710 is implemented with a scissor mechanism, although other types of key-switch mechanisms are also contemplated. As an example, consider FIG. 7B which illustrates an example 712 in which dome switch 710 is implemented with a scissor mechanism 714. In this example, the key 112 is attached to the housing of the keyboard device 104 via the scissor mechanism 714, which includes two pieces that interlock in a "scissor-like" fashion. The dome switch 710 is positioned directly beneath the key 112, and includes first and second legs which are connected to the housing of the keyboard device 104. In addition, the dome switch includes a plunger 716 which is positioned between the first and second legs, and raised slightly off of the single-layer membrane 702. The conductive material 708 is positioned on the plunger 716 and oriented towards the first and second conductive traces 704 and 706, respectively, on the single-layer membrane 702. When key 112 is depressed, the plunger 716 of dome switch 710 moves downwards such that the conductive material 708 electrically connects the first conductive trace 704 and the second conductive trace 706 of the respective key 112.

The single-layer membrane 702 may have a thickness of approximately 0.05 millimeters. Thus, replacing the three-layer membrane described in FIG. 3, 4, or 6 (with a thickness of approximately 0.25 millimeters) with single-layer membrane 702, reduces the thickness of the keyboard by 0.20 millimeters or more.

The redesigned single-layer membrane 702 can be implemented in any type of keyboard device 104 which utilizes a three-layer membrane to sense keypresses, such as the keyboard with stiffener plate of FIGS. 3 and 4, or the keyboard with structural PCB of FIG. 5, or any other type of existing keyboard which utilizes a three-layer membrane to sense keypresses.

In one or more implementations, the keyboard device 104 can be implemented without any type of membrane by moving the first and second conductive traces from the membrane to the structural PCB. Notably, placing the first and second conductive traces on the structural PCB, may reduce the total thickness of the keyboard device 104 by as much as 0.20 to 0.30 millimeters as compared to existing keyboards that utilize a three-layer membrane.

Figure 8:
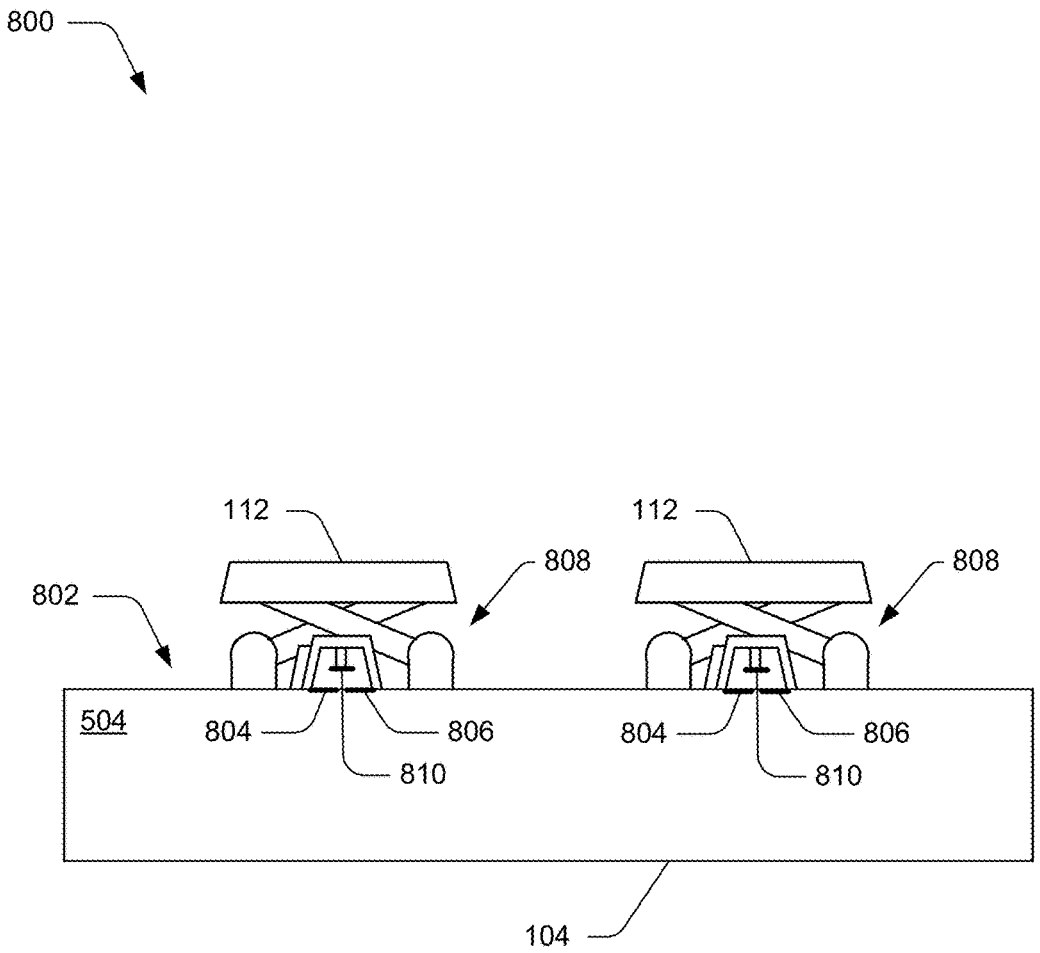
FIG. 8 depicts an example of the keyboard device of FIG. 1 in accordance with one or more implementations.

As an example, consider FIG. 8 which depicts an example 800 of the keyboard device 104 of FIG. 1 in accordance with one or more implementations.

In this example, keyboard device 104 includes housing 802 which includes the structural PCB 504. As described above, the structural PCB 504 may include, for each key 112, a light source 510 configured to be controlled to illuminate the respective key 112.

For each key 112, the structural PCB 504 further includes a first conductive trace 804 and a second conductive trace 806. The keyboard device 104 includes a key-switch mechanism 808. The key-switch mechanism 808 includes a conductive material 810 oriented towards the first conductive trace 804 and the second conductive trace 806. As described with regards to FIG. 7, the key-switch mechanism 808 is configured to cause the conductive material 810 to move downwards, when the key 112 is depressed, to electrically connect the first conductive trace 804 and the second conductive trace 806 of the respective key 112.

For example, as discussed with regards to FIG. 7, the key-switch mechanism 808 may include a scissor mechanism and a dome switch, although other types of key-switch mechanisms are also contemplated. In this case, the key 112 is attached to the structural PCB 504 via the scissor mechanism, which includes two pieces that interlock in a "scissor-like" fashion. The dome switch is positioned directly beneath the key 112, and includes first and second legs, which are connected to the structural PCB 504. In addition, the dome switch may include a plunger which is positioned between the first and second legs, and raised slightly off of the structural PCB 504. The conductive material 810 is positioned on the plunger and oriented towards the first and second conductive traces 804 and 806, respectively, on the structural PCB. When key 112 is depressed, the plunger of the dome switch moves downwards such that the conductive material 810 electrically connects the first conductive trace 804 and the second conductive trace 806. As described throughout, the keyboard controller 306 can detect this electrical connection and register it as a keypress of the respective key 112.

In one or more implementations, the keyboard bracket 404 of FIG. 4 can be eliminated from the keyboard device 104 by mounting or bonding the key-switch mechanism 808 directly to the structural PCB 504. The key-switch mechanism may be bonded directly to the structural PCB 504 in a variety of different ways, such as using an adhesive or heat-stakes. Doing so further reduces the thickness of the keyboard device 104 by as much as 0.3 millimeters, while also reducing the weight of the keyboard device 104. In addition, bonding the key-switch mechanism directly to the structural PCB may also increase the stiffness of the keyboard device 104 as compared to existing thin keyboards where the key-switch mechanism is mounted to a keyboard bracket.

Notably, therefore, the housing of keyboard device 104 in example 800 includes just the structural PCB 504, as the three-layer membrane 402, keyboard bracket 404, backlight 406, and stiffener plate 304 of FIG. 4 have been completely eliminated. Thus, a thickness of the housing of keyboard device 104 in example 800 may be reduced to just the thickness of the structural PCB, which may be 0.7 millimeters or less.

Furthermore, in this implementation, circuitry on the structural PCB 504 can be utilized to connect the conductive traces to the keyboard controller 306 and to the connection portion 202. As such, the flexible printed circuit board may be reduced or completely eliminated from the keyboard device 104. Doing so results in a further reduction in the cost of manufacturing the keyboard device 104.

Example Procedure

The following discussion describes keypress detection techniques that may be implemented utilizing the previously described thin keyboards. Aspects of each of the procedures may be implemented in hardware, firmware, or software, or a combination thereof. The procedures are shown as a set of blocks that specify operations performed by one or more devices and are not necessarily limited to the orders shown for performing the operations by the respective blocks. In portions of the following discussion, reference will be made to the figures described above.

Functionality, features, and concepts described in relation to the examples of FIGS. 1-8 may be employed in the context of the procedures described herein. Further, functionality, features, and concepts described in relation to different procedures below may be interchanged among the different procedures and are not limited to implementation in the context of an individual procedure. Moreover, blocks associated with different representative procedures and corresponding figures herein may be applied together and/or combined in different ways. Thus, individual functionality, features, and concepts described in relation to different example environments, devices, components, and procedures herein may be used in any suitable combinations and are not limited to the particular combinations represented by the enumerated examples.

Figure 9:
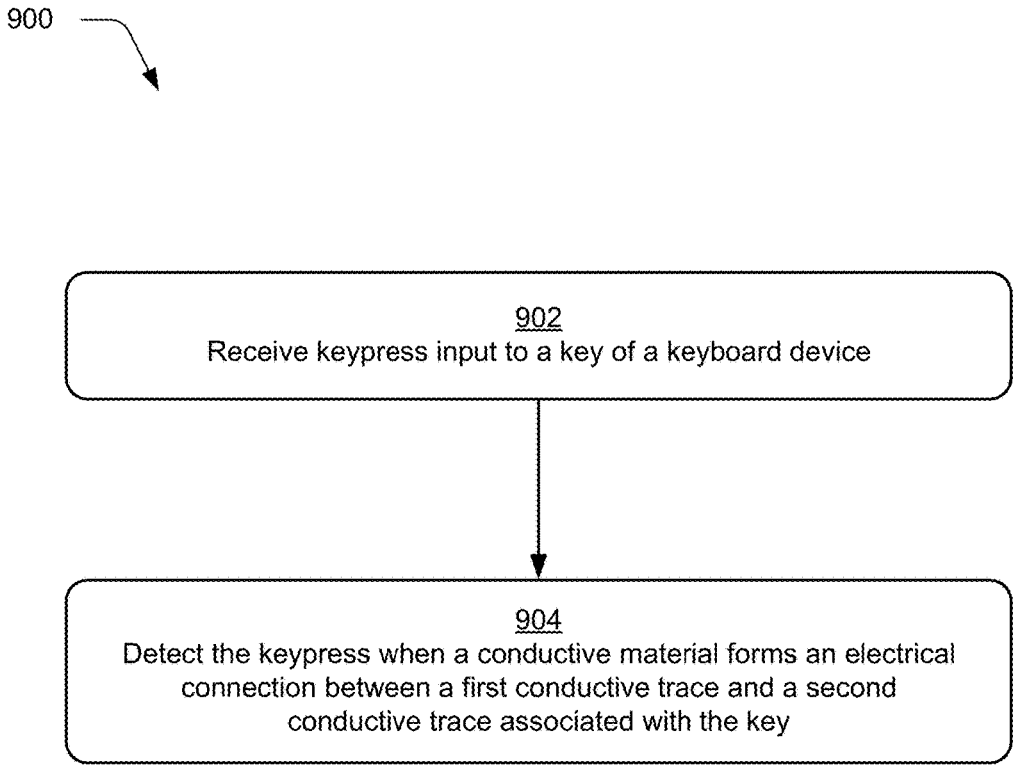
FIG. 9 depicts a procedure in an example implementation in which keypresses are detected using a keyboard controller of a thin keyboard device.

FIG. 9 depicts a procedure 900 in an example implementation in which keypresses are detected using a keyboard controller of a thin keyboard device.

At 902, keypress input to a key of a keyboard device is received. For example, keypress input to a key 112 of keyboard device 104 is received when a user presses the key 112.

At 904, the keypress is detected when a conductive material forms an electrical connection between a first conductive trace and a second conductive trace associated with the key.

For example, keyboard controller 306 can detect the keypress by detection of the formation of an electrical connection associated with a respective key 112 when a conductive material makes contact with first and second conductive traces associated with the respective key 112.

In one or more implementations, the keyboard controller 306 detects the electrical connection between first conductive trace 610 and second conductive trace 612 positioned on the bottom layer 608 of three-layer membrane 602 when conductive material 614, positioned on top layer 604 of three-layer membrane 602, makes contact with first conductive trace 610 and second conductive trace 612.

In one or more implementations, the keyboard controller 306 detects the electrical connection between first conductive trace 704 and second conductive trace 706 positioned on single-layer membrane 702 when conductive material 708, positioned on the switching mechanism (e.g., dome switch 710), makes contact with first conductive trace 704 and second conductive trace 706.

In one or more implementations, the keyboard controller 306 detects the electrical connection between first conductive trace 804 and second conductive trace 806 positioned on structural PCB 504 when conductive material 810, positioned on switching mechanism 808 (e.g., dome switch 710), makes contact with first conductive trace 804 and second conductive trace 806.

Example System and Device

Figure 10:
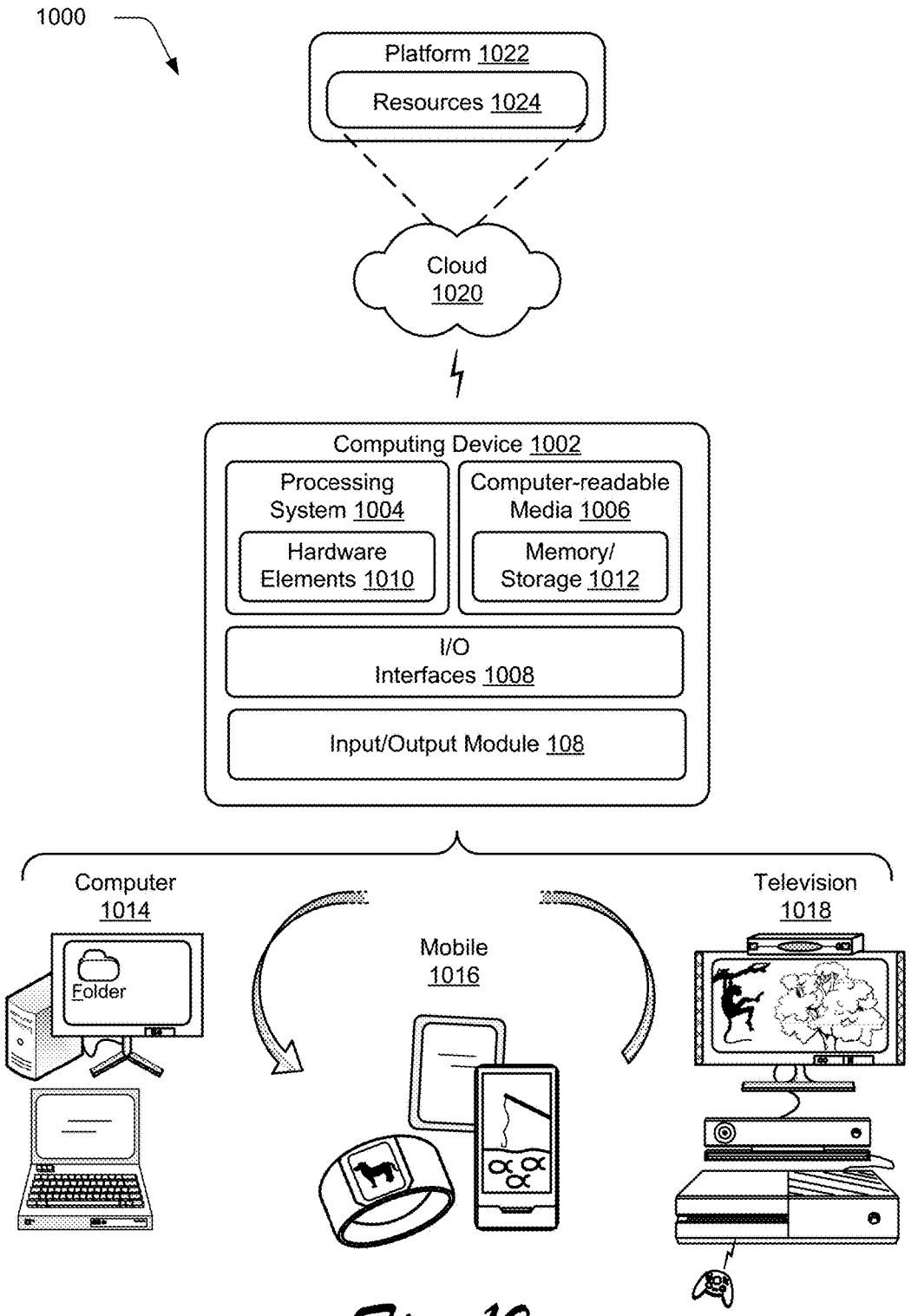
FIG. 10 illustrates an example system including various components of an example device that can be implemented as any type of computing device as described with reference to FIGS. 1-9 to implement the techniques described herein.

FIG. 10 illustrates an example system generally at 1000 that includes an example computing device 1002 that is representative of one or more computing systems and/or devices that may implement the various techniques described herein. This is illustrated through inclusion of the input/output module 108. The computing device 1002 may be, for example, a server of a service provider, a device associated with a client (e.g., a client device), an on-chip system, and/or any other suitable computing device or computing system.

The example computing device 1002 as illustrated includes a processing system 1004, one or more computer-readable media 1006, and one or more I/O interface 1008 that are communicatively coupled, one to another. Although not shown, the computing device 1002 may further include a system bus or other data and command transfer system that couples the various components, one to another. A system bus can include any one or combination of different bus structures, such as a memory bus or memory controller, a peripheral bus, a universal serial bus, and/or a processor or local bus that utilizes any of a variety of bus architectures. A variety of other examples are also contemplated, such as control and data lines.

The processing system 1004 is representative of functionality to perform one or more operations using hardware. Accordingly, the processing system 1004 is illustrated as including hardware element 1010 that may be configured as processors, functional blocks, and so forth. This may include implementation in hardware as an application specific integrated circuit or other logic device formed using one or more semiconductors. The hardware elements 1010 are not limited by the materials from which they are formed or the processing mechanisms employed therein. For example, processors may be comprised of semiconductor(s) and/or transistors (e.g., electronic integrated circuits (ICs)). In such a context, processor-executable instructions may be electronically-executable instructions.

The computer-readable storage media 1006 is illustrated as including memory/storage 1012. The memory/storage 1012 represents memory/storage capacity associated with one or more computer-readable media. The memory/storage component 1012 may include volatile media (such as random access memory (RAM)) and/or nonvolatile media (such as read only memory (ROM), Flash memory, optical disks, magnetic disks, and so forth). The memory/storage component 1012 may include fixed media (e.g., RAM, ROM, a fixed hard drive, and so on) as well as removable media (e.g., Flash memory, a removable hard drive, an optical disc, and so forth). The computer-readable media 1006 may be configured in a variety of other ways as further described below.

Input/output interface(s) 1008 are representative of functionality to allow a user to enter commands and information to computing device 1002, and also allow information to be presented to the user and/or other components or devices using various input/output devices. Examples of input devices include a keyboard, a cursor control device (e.g., a mouse), a microphone, a scanner, touch functionality (e.g., capacitive or other sensors that are configured to detect physical touch), a camera (e.g., which may employ visible or non-visible wavelengths such as infrared frequencies to recognize movement as gestures that do not involve touch), and so forth. Examples of output devices include a display device (e.g., a monitor or projector), speakers, a printer, a network card, tactile-response device, and so forth. Thus, the computing device 1002 may be configured in a variety of ways as further described below to support user interaction.

Various techniques may be described herein in the general context of software, hardware elements, or program modules. Generally, such modules include routines, programs, objects, elements, components, data structures, and so forth that perform particular tasks or implement particular abstract data types. The terms "module," "functionality," and "component" as used herein generally represent software, firmware, hardware, or a combination thereof. The features of the techniques described herein are platform-independent, meaning that the techniques may be implemented on a variety of commercial computing platforms having a variety of processors.

An implementation of the described modules and techniques may be stored on or transmitted across some form of computer-readable media. The computer-readable media may include a variety of media that may be accessed by the computing device 1002. By way of example, and not limitation, computer-readable media may include "computer-readable storage media" and "computer-readable signal media."

"Computer-readable storage media" may refer to media and/or devices that enable persistent and/or non-transitory storage of information in contrast to mere signal transmission, carrier waves, or signals per se. Thus, computer-readable storage media refers to non-signal bearing media. The computer-readable storage media includes hardware such as volatile and non-volatile, removable and non-removable media and/or storage devices implemented in a method or technology suitable for storage of information such as computer readable instructions, data structures, program modules, logic elements/circuits, or other data. Examples of computer-readable storage media may include, but are not limited to, RAM, ROM, EEPROM, flash memory or other memory technology, CD-ROM, digital versatile disks (DVD) or other optical storage, hard disks, magnetic cassettes, magnetic tape, magnetic disk storage or other magnetic storage devices, or other storage device, tangible media, or article of manufacture suitable to store the desired information and which may be accessed by a computer.

"Computer-readable signal media" may refer to a signal-bearing medium that is configured to transmit instructions to the hardware of the computing device 1002, such as via a network. Signal media typically may embody computer readable instructions, data structures, program modules, or other data in a modulated data signal, such as carrier waves, data signals, or other transport mechanism. Signal media also include any information delivery media. The term "modulated data signal" means a signal that has one or more of its characteristics set or changed in such a manner as to encode information in the signal. By way of example, and not limitation, communication media include wired media such as a wired network or direct-wired connection, and wireless media such as acoustic, RF, infrared, and other wireless media.

As previously described, hardware elements 1010 and computer-readable media 1006 are representative of modules, programmable device logic and/or fixed device logic implemented in a hardware form that may be employed in some examples to implement at least some aspects of the techniques described herein, such as to perform one or more instructions. Hardware may include components of an integrated circuit or on-chip system, an application-specific integrated circuit (ASIC), a field-programmable gate array (FPGA), a complex programmable logic device (CPLD), and other implementations in silicon or other hardware. In this context, hardware may operate as a processing device that performs program tasks defined by instructions and/or logic embodied by the hardware as well as a hardware utilized to store instructions for execution, e.g., the computer-readable storage media described previously.

Combinations of the foregoing may also be employed to implement various techniques described herein. Accordingly, software, hardware, or executable modules may be implemented as one or more instructions and/or logic embodied on some form of computer-readable storage media and/or by one or more hardware elements 1010. The computing device 1002 may be configured to implement particular instructions and/or functions corresponding to the software and/or hardware modules. Accordingly, implementation of a module that is executable by the computing device 1002 as software may be achieved at least partially in hardware, e.g., through use of computer-readable storage media and/or hardware elements 1010 of the processing system 1004. The instructions and/or functions may be executable/operable by one or more articles of manufacture (for example, one or more computing devices 1002 and/or processing systems 1004) to implement techniques, modules, and examples described herein.

As further illustrated in FIG. 10, the example system 1000 enables ubiquitous environments for a seamless user experience when running applications on a personal computer (PC), a television device, and/or a mobile device. Services and applications run substantially similar in all three environments for a common user experience when transitioning from one device to the next while utilizing an application, playing a video game, watching a video, and so on.

In the example system 1000, multiple devices are interconnected through a central computing device. The central computing device may be local to the multiple devices or may be located remotely from the multiple devices. In one implementation, the central computing device may be a cloud of one or more server computers that are connected to the multiple devices through a network, the Internet, or other data communication link.

In an implementation, this interconnection architecture enables functionality to be delivered across multiple devices to provide a common and seamless experience to a user of the multiple devices. Each of the multiple devices may have different physical requirements and capabilities, and the central computing device uses a platform to enable the delivery of an experience to the device that is both tailored to the device and yet common to all devices. In another implementation, a class of target devices is created and experiences are tailored to the generic class of devices. A class of devices may be defined by physical features, types of usage, or other common characteristics of the devices.

In various implementations, the computing device 1002 may assume a variety of different configurations, such as for computer 1014, mobile 1016, and television 1018 uses. Each of these configurations includes devices that may have generally different constructs and capabilities, and thus the computing device 1002 may be configured according to one or more of the different device classes. For instance, the computing device 1002 may be implemented as the computer 1014 class of a device that includes a personal computer, desktop computer, a multi-screen computer, laptop computer, netbook, and so on.

The computing device 1002 may also be implemented as the mobile 1016 class of device that includes mobile devices, such as a mobile phone, wearables (e.g., wrist bands, pendants, rings, etc.) portable music player, portable gaming device, a tablet computer, a multi-screen computer, and so on. The computing device 1002 may also be implemented as the television 1018 class of device that includes devices having or connected to generally larger screens in casual viewing environments. These devices include televisions, set-top boxes, gaming consoles, and so on. Other devices are also contemplated, such as appliances, thermostats and so on as part of the "Internet of Things."

The techniques described herein may be supported by these various configurations of the computing device 1002 and are not limited to the specific examples of the techniques described herein. This functionality may also be implemented all or in part through use of a distributed system, such as over a "cloud" 1020 via a platform 1022 as described below.

The cloud 1020 includes and/or is representative of a platform 1022 for resources 1024. The platform 1022 abstracts underlying functionality of hardware (e.g., servers) and software resources of the cloud 1020. The resources 1024 may include applications and/or data that can be utilized while computer processing is executed on servers that are remote from the computing device 1002. Resources 1024 can also include services provided over the Internet and/or through a subscriber network, such as a cellular or Wi-Fi network.

The platform 1022 may abstract resources and functions to connect the computing device 1002 with other computing devices. The platform 1022 may also serve to abstract scaling of resources to provide a corresponding level of scale to encountered demand for the resources 1024 that are implemented via the platform 1022. Accordingly, in an interconnected device, implementation of functionality described herein may be distributed throughout the system 1000. For example, the functionality may be implemented in part on the computing device 1002 as well as via the platform 1022 that abstracts the functionality of the cloud 1020.

Conclusion and Example Implementations

Example implementations described herein include, but are not limited to, one or any combinations of one or more of the following examples:

In one or more examples, a keyboard device includes: a plurality of keys; a housing comprising a structural printed circuit board (PCB), the structural PCB comprising, for each of the plurality of keys, a first conductive trace and a second conductive trace, each of the plurality of keys mounted to the structural PCB above the respective first conductive trace and second conductive trace; and a key-switch mechanism for each of the plurality of keys, the key-switch mechanism including a conductive material oriented towards the first conductive trace and the second conductive trace, the key-switch mechanism configured to cause the conductive material to move downwards, when the key is depressed, to electrically connect the first conductive trace and the second conductive trace of the depressed key.

An example as described alone or in combination with any of the other examples described above or below, further comprising a keyboard controller configured to detect the electrical connection between the first conductive trace and the second conductive trace of the key, and to communicate a keypress signal identifying that the key has been depressed to a computing device.

An example as described alone or in combination with any of the other examples described above or below, further comprising circuitry on the structural PCB that couple the first conductive trace and the second conductive trace to the keyboard controller and to a connection portion configured to transfer the keypress signal to the computing device.

An example as described alone or in combination with any of the other examples described above or below, further comprising a trackpad, and wherein the keyboard controller is positioned beneath a trackpad of the keyboard device.

An example as described alone or in combination with any of the other examples described above or below, wherein the key-switch mechanism comprises a scissor mechanism that connects the key to the structural PCB and a dome switch mounted to the structural PCB beneath the key, the conductive material positioned on a plunger of the dome switch that moves downwards to make contact with the first conductive trace and the second conductive trace when the key is depressed.

An example as described alone or in combination with any of the other examples described above or below, further comprising one or more light sources mounted to the structural PCB beneath each of the plurality of keys, the light sources configured to illuminate the respective keys of the keyboard device.

An example as described alone or in combination with any of the other examples described above or below, wherein the keyboard device does not include one or more of a membrane, a backlight, a stiffener plate, or a keyboard bracket.

An example as described alone or in combination with any of the other examples described above or below, wherein a thickness of the housing comprises 0.7 millimeters to 1.0 millimeters.

An example as described alone or in combination with any of the other examples described above or below, wherein the structural PCB comprises a single-layer or multiple-layer PCB.

In one or more examples, a keyboard device includes: a plurality of keys; a housing comprising a single-layer membrane, the single-layer membrane comprising, for each of the plurality of keys, a first conductive trace and a second conductive trace, each of the plurality of keys mounted directly to the housing above the respective first conductive trace and second conductive trace of the single-layer membrane; and a key-switch mechanism for each of the plurality of keys, the key-switch mechanism including a conductive material oriented towards the first conductive trace and the second conductive trace, the key-switch mechanism configured to cause the conductive material to move downwards, when the key is depressed, to electrically connect the first conductive trace and the second conductive trace of the depressed key.

An example as described alone or in combination with any of the other examples described above or below, wherein the housing further comprises a structural printed circuit board (PCB).

An example as described alone or in combination with any of the other examples described above or below, further comprising a keyboard controller configured to detect the electrical connection between the first conductive trace and the second conductive trace of the key, and to communicate a keypress signal identifying that the key has been depressed to a computing device.

An example as described alone or in combination with any of the other examples described above or below, further comprising a first flexible printed circuit board connector (FPC) coupled to the keyboard controller and a second FPC coupled to a connection portion configured to interface the keyboard device with a computing device, the structural PCB further comprising circuitry configured to connect the first FPC to the second FPC.

An example as described alone or in combination with any of the other examples described above or below, further comprising one or more light sources mounted to the structural PCB beneath each of the plurality of keys, the light sources configured to illuminate the respective keys of the keyboard device.

An example as described alone or in combination with any of the other examples described above or below, wherein the key-switch mechanism comprises a scissor mechanism that connects the key to the housing and a dome switch mounted to the housing beneath the key, the conductive material positioned on a plunger of the dome switch that moves downwards to make contact with the first conductive trace and the second conductive trace when the key is depressed.

In one or more examples, a keyboard device includes: a plurality of keys; a housing comprising a three-layer membrane, the three-layer membrane comprising, for each of the plurality of keys, a first conductive trace and a second conductive trace positioned on a bottom layer of the three-layer membrane, a conductive material positioned on a top layer of the three-layer membrane, and a spacer layer positioned between the top layer and the bottom layer of the three-layer membrane, each of the plurality of keys mounted to the housing above the respective first conductive trace and second conductive trace of the three-layer membrane; and a key-switch mechanism for each of the plurality of keys, the key-switch mechanism configured to collapse the three-layer membrane, when the key is depressed, such that the conductive material on the top layer of the three-layer membrane moves downwards through the spacer layer to electrically connect the first conductive trace and the second conductive trace of the depressed key.

An example as described alone or in combination with any of the other examples described above or below, wherein the housing further comprises a structural printed circuit board (PCB).

An example as described alone or in combination with any of the other examples described above or below, further comprising one or more light sources mounted to the structural PCB beneath each of the plurality of keys, the light sources configured to be illuminate the respective keys of the keyboard device.

An example as described alone or in combination with any of the other examples described above or below, wherein the housing further comprises a stiffener plate, a keyboard bracket, and a backlight.

An example as described alone or in combination with any of the other examples described above or below, wherein the housing does not include a stiffener plate, a keyboard bracket, or a backlight.

Although the example implementations have been described in language specific to structural features and/or methodological acts, it is to be understood that the implementations defined in the appended claims is not necessarily limited to the specific features or acts described. Rather, the specific features and acts are disclosed as example forms of implementing the claimed features.

What is claimed is:

1. A keyboard device comprising:

a plurality of keys;

a housing comprising a structural printed circuit board (PCB), the structural PCB comprising, for each of the plurality of keys, a first conductive trace and a second conductive trace, each of the plurality of keys positioned above the respective first conductive trace and the second conductive trace; and a key-switch mechanism for each of the plurality of keys, the key-switch mechanism including a conductive material oriented towards the first conductive trace and the second conductive trace, the key-switch mechanism configured to cause the conductive material to move downwards, when the key is depressed, to electrically connect the first conductive trace and the second conductive trace of the depressed key, the key-switch mechanism mounted to the structural PCB.

2. The keyboard device of claim 1, wherein the keyboard device does not include:

a membrane;

a backlight;

a stiffener plate; and a keyboard bracket.

3. The keyboard device of claim 1, wherein the key-switch mechanism comprises a scissor mechanism that connects the key to the structural PCB and a dome switch mounted to the structural PCB beneath the key, the conductive material positioned on a plunger of the dome switch that moves downwards to make contact with the first conductive trace and the second conductive trace when the key is depressed.

4. The keyboard device of claim 1, further comprising one or more light sources mounted to the structural PCB beneath each of the plurality of keys, the light sources configured to illuminate the plurality of keys of the keyboard device.

5. The keyboard device of claim 1, wherein the keyboard device does not include one or more of a membrane, a backlight, a stiffener plate, or a keyboard bracket.

6. The keyboard device of claim 1, wherein a thickness of the housing comprises 0.7 millimeters to 1.0 millimeters.

7. The keyboard device of claim 1, further comprising a keyboard controller configured to detect the electrical connection between the first conductive trace and the second conductive trace of the key, and to communicate a keypress signal identifying that the key has been depressed to a computing device.

8. The keyboard device of claim 7, wherein the structural PCB comprises a single-layer or multiple-layer PCB.

9. The keyboard device of claim 7, further comprising circuitry on the structural PCB that couple the first conductive trace and the second conductive trace to the keyboard controller and to a connection portion configured to transfer the keypress signal to the computing device.

10. The keyboard device of claim 7, further comprising a trackpad, and wherein the keyboard controller is positioned beneath the trackpad of the keyboard device.

11. A keyboard device comprising:

a plurality of keys;

a housing comprising a structural printed circuit board (PCB) and a single-layer membrane positioned over the structural PCB, the single-layer membrane comprising, for each of the plurality of keys, a first conductive trace and a second conductive trace, each of the plurality of keys mounted directly to the housing above the respective first conductive trace and the second conductive trace of the single-layer membrane; and a key-switch mechanism for each of the plurality of keys, the key-switch mechanism including a conductive material oriented towards the first conductive trace and the second conductive trace, the key-switch mechanism configured to cause the conductive material to move downwards, when the key is depressed, to electrically connect the first conductive trace and the second conductive trace of the depressed key.

12. The keyboard device of claim 11, further comprising one or more light sources mounted to the structural PCB beneath each of the plurality of keys, the light sources configured to illuminate the respective keys of the keyboard device.

13. The keyboard device of claim 11, wherein the key-switch mechanism comprises a scissor mechanism that connects the key to the housing and a dome switch mounted to the housing beneath the key, the conductive material positioned on a plunger of the dome switch that moves downwards to make contact with the first conductive trace and the second conductive trace when the key is depressed.

14. The keyboard device of claim 11, further comprising a keyboard controller configured to detect the electrical connection between the first conductive trace and the second conductive trace of the key, and to communicate a keypress signal identifying that the key has been depressed to a computing device.

15. The keyboard device of claim 14, further comprising a first flexible printed circuit board connector (FPC) coupled to the keyboard controller and a second FPC coupled to a connection portion configured to interface the keyboard device with a computing device, the structural PCB further comprising circuitry configured to connect the first FPC to the second FPC.

16. An input device comprising:

a plurality of keys;

a housing comprising a structural printed circuit board (PCB), the structural PCB comprising, for at least one key of the plurality of keys, a first conductive trace and a second conductive trace, the at least one key positioned above the respective first conductive trace and the second conductive trace; and a key-switch mechanism for the at least one key, the key-switch mechanism including a conductive material oriented towards the first conductive trace and the second conductive trace, the key-switch mechanism configured to cause the conductive material to move downwards, when the at least one key is depressed, to electrically connect the first conductive trace and the second conductive trace of the depressed key, the key-switch mechanism mounted to the structural PCB.

17. The input device of claim 16, further comprising a controller configured to detect the electrical connection between the first conductive trace and the second conductive trace of the at least one key, and to communicate a keypress signal identifying that the at least one key has been depressed to a computing device.

18. The input device of claim 17, further comprising a trackpad, and wherein the controller is positioned beneath the trackpad of the input device.

19. The input device of claim 16, further comprising at least one light source mounted to the structural PCB beneath the at least one key, the light source configured to illuminate the at least one key.

* * * * *